US008844474B2

(12) United States Patent
Fukuoka et al.

(10) Patent No.: US 8,844,474 B2
(45) Date of Patent: Sep. 30, 2014

(54) INTERNAL COMBUSTION ENGINE AND WATER OUTLET STRUCTURE OF INTERNAL COMBUSTION ENGINE

(71) Applicant: Honda Motor Co., Ltd., Tokyo (JP)

(72) Inventors: Satoshi Fukuoka, Wako (JP); Yoshihiro Hattori, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/678,555

(22) Filed: Nov. 16, 2012

(65) Prior Publication Data

US 2013/0125843 A1 May 23, 2013

(30) Foreign Application Priority Data

Nov. 21, 2011 (JP) ..... 2011-253521

(51) Int. Cl.
*F01P 3/02* (2006.01)
*F01P 7/16* (2006.01)

(52) U.S. Cl.
CPC ... *F01P 3/02* (2013.01); *F01P 7/16* (2013.01); *F01P 2003/028* (2013.01)
USPC ..... 123/41.08; 123/41.1

(58) Field of Classification Search
CPC ..... F01P 3/02; F01P 3/12; F01P 3/20; F01P 7/14; F01P 7/16; F01P 7/167; F01P 11/00
USPC ..... 123/41.1, 41.05, 41.08, 41.09, 41.44, 123/195 A
See application file for complete search history.

(56) References Cited

U.S. PATENT DOCUMENTS

| | | | | |
|---|---|---|---|---|
| 6,182,616 | B1 * | 2/2001 | Itoh et al. | 123/41.1 |
| 6,732,679 | B2 * | 5/2004 | Iizuka | 123/41.1 |
| 6,758,173 | B2 * | 7/2004 | Saito et al. | 123/41.74 |
| 7,086,355 | B2 * | 8/2006 | Yamamoto | 123/41.72 |
| 7,171,926 | B2 * | 2/2007 | Ito et al. | 123/41.01 |

(Continued)

FOREIGN PATENT DOCUMENTS

| | | | | |
|---|---|---|---|---|
| JP | 04-6725 U | | 1/1992 | |
| JP | 04342822 A | * | 11/1992 | F01P 7/16 |

(Continued)

OTHER PUBLICATIONS

Machine translation of Detailed Description for JP2008-002400, pp. 1-11.*

(Continued)

*Primary Examiner* — Noah Kamen
*Assistant Examiner* — Grant Moubry
(74) *Attorney, Agent, or Firm* — Mori & Ward, LLP

(57) ABSTRACT

A water outlet structure of an internal combustion engine includes a water outlet and a thermostat. The water outlet includes a cooling-water inflow portion, a radiator outflow passage, and a bypass passage. The cooling-water inflow portion is provided to face a cooling-water outlet of a cylinder head. Cooling water is to flow out to a radiator through the radiator outflow passage. The radiator outflow passage linearly extends from the cooling-water inflow portion. The bypass passage linearly and obliquely extends from the cooling-water inflow portion to provide a water flow at an acute angle to a water flow in the radiator outflow passage. The thermostat is provided integrally with the water outlet and includes a thermo housing provided downstream of the bypass passage.

9 Claims, 9 Drawing Sheets

(56) References Cited

U.S. PATENT DOCUMENTS

| | | | | |
|---|---|---|---|---|
| 7,222,592 | B2 * | 5/2007 | Guyon et al. | 123/41.08 |
| 7,299,771 | B2 * | 11/2007 | Wei et al. | 123/41.08 |
| 8,220,421 | B2 * | 7/2012 | Utsuno | 123/41.08 |
| 2004/0261730 | A1 * | 12/2004 | Yi | 123/41.1 |
| 2012/0118248 | A1 * | 5/2012 | Mehring et al. | 123/41.08 |

FOREIGN PATENT DOCUMENTS

| | | |
|---|---|---|
| JP | 11-336544 | 12/1999 |
| JP | 2005-147027 | 6/2005 |
| JP | 2006-070760 | 3/2006 |
| JP | 2008-002400 | 1/2008 |
| JP | 2010-209882 | 9/2010 |

OTHER PUBLICATIONS

Japanese Office Action for corresponding JP Application No. 2011-253521, Jul. 3, 2013.

Japanese Office Action for corresponding JP Application No. 2011-253521, Dec. 3, 2013.

* cited by examiner

INTERNAL COMBUSTION ENGINE AND WATER OUTLET STRUCTURE OF INTERNAL COMBUSTION ENGINE

CROSS-REFERENCE TO RELATED APPLICATIONS

The present application claims priority under 35 U.S.C. §119 to Japanese Patent Application No. 2011-253521, filed Nov. 21, 2011, entitled "Water Outlet Structure of Internal Combustion Engine." The contents of this application are incorporated herein by reference in their entirety.

BACKGROUND OF THE INVENTION

1. Field of the Invention

The present disclosure relates to an internal combustion engine and a water outlet structure of the internal combustion engine.

2. Discussion of the Background

For example, Japanese Unexamined Utility Model Registration Application Publication No. 4-006725 proposes a water outlet structure in which a thermostat is incorporated in a water outlet provided at a cooling-water outlet of a cylinder head in a water-cooled internal combustion engine. The thermostat selectively forms, from cooling water flowing into the water outlet through the cooling-water outlet of the cylinder head, a water flow that reaches a radiator and a water flow that directly reaches a water pump via a bypass passage.

In the proposed water outlet structure, the water outlet is attached to the cooling-water outlet provided at an end of the cylinder head in a cylinder arrangement direction, and the water outlet is provided integrally with a thermo case portion (thermo housing) of the thermostat.

The bypass passage projects perpendicularly to a cylindrical portion of the water outlet that extends perpendicularly to an end face of the cooling-water outlet of the cylinder head, and the thermo case portion is provided on an extension of the bypass passage.

The thermo case portion has an exit for the water pump, and a thermo cap (thermo cover) covering the thermo case portion has an entrance for cooling water flowing from the radiator.

An end portion of the cylindrical portion of the water outlet serves as an exit for the radiator.

In a cold state, the thermostat closes the entrance for cooling water from the radiator and opens the exit of the bypass passage. Hence, cooling water flowing from the cooling-water outlet of the cylinder head into the water outlet does not circulate through the radiator, but directly flows to the water pump via the bypass passage to promote a warm-up.

In a hot state, the thermostat opens the entrance for cooling water from the radiator and closes the exit of the bypass passage. Hence, cooling water flowing in the water outlet circulates through the radiator, is cooled by heat exchange, and is then supplied to the engine body to cool a cylinder block and the cylinder head.

SUMMARY OF THE INVENTION

According to one aspect of the present invention, a water outlet structure of an internal combustion engine includes a water outlet and a thermostat. The water outlet is provided to be attached to a cooling-water outlet provided at an end of a cylinder head of the internal combustion engine in a cylinder arrangement direction of the internal combustion engine. The water outlet includes a cooling-water inflow portion, a radiator outflow passage, and a bypass passage. The cooling-water inflow portion is provided to face the cooling-water outlet of the cylinder head. Cooling water is to flow out to a radiator through the radiator outflow passage. The radiator outflow passage linearly extends from the cooling-water inflow portion. The bypass passage linearly and obliquely extends from the cooling-water inflow portion to provide a water flow at an acute angle to a water flow in the radiator outflow passage. The thermostat is provided integrally with the water outlet and includes a thermo housing provided downstream of the bypass passage.

According to another aspect of the present invention, an internal combustion engine includes a cylinder head, a water outlet, and a thermostat. The cylinder head includes a cooling-water outlet provided at an end of the cylinder head in a cylinder arrangement direction of the internal combustion engine. The water outlet is attached to the cooling-water outlet and includes a cooling-water inflow portion, a radiator outflow passage, and a bypass passage. The cooling-water inflow portion is provided to face the cooling-water outlet of the cylinder head. Cooling water is to flow out to a radiator through the radiator outflow passage. The radiator outflow passage linearly extends from the cooling-water inflow portion. The bypass passage linearly and obliquely extends from the cooling-water inflow portion to provide a water flow at an acute angle to a water flow in the radiator outflow passage. The thermostat is provided integrally with the water outlet and includes a thermo housing provided downstream of the bypass passage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
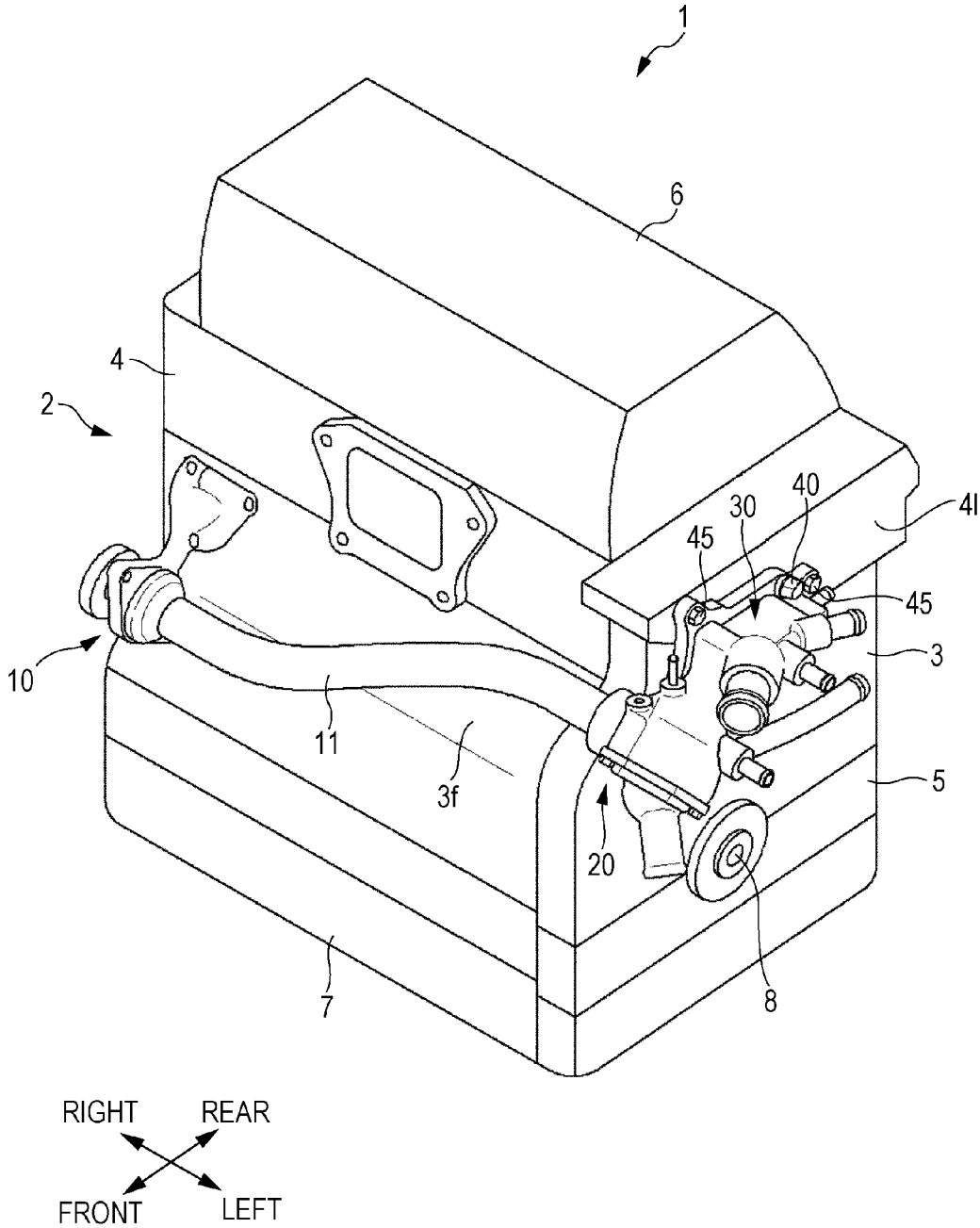
FIG. 1 is a partially omitted perspective view illustrating an overall configuration of an internal combustion engine according to an embodiment of the present disclosure.

The embodiments will now be described with reference to the accompanying drawings, wherein like reference numerals designate corresponding or identical elements throughout the various drawings.

The embodiment of the present disclosure will be described below with reference to FIGS. 1 to 10.

Referring to FIG. 1, an internal combustion engine 1 of the embodiment is an in-line four-cylinder and four-stroke water-cooled internal combustion engine. The internal combustion engine 1 is transversely installed in a vehicle with a crankshaft 8 extending in a right-left direction.

In this specification, front, rear, right, and left sides are determined with reference to the vehicle.

As illustrated in FIG. 1, in an engine body 2 of the internal combustion engine 1, a lower case 5 is joined to a lower side of a cylinder block 3, in which cylinders are arranged in the right-left direction, in a manner such that the crankshaft 8 is rotatably clamped between the cylinder block 3 and the lower case 5. A cylinder head 4 is provided on the cylinder block 3, and is covered with a cylinder head cover 6. An oil pan 7 is joined to a lower side of the lower case 5.

A water pump 10 is attached to a right portion of a front side face 3*f* of the cylinder block 3, and a water outlet 30 is attached to a front portion of a left side face 41 of the cylinder head 4.

Cooling water ejected from the water pump 10 circulates through a water jacket in the cylinder block 3, and subsequently circulates through a water jacket in the cylinder head 4. Then, the cooling water flows out to the water outlet 30, and is distributed from the water outlet 30 to predetermined portions.

Figure 2:
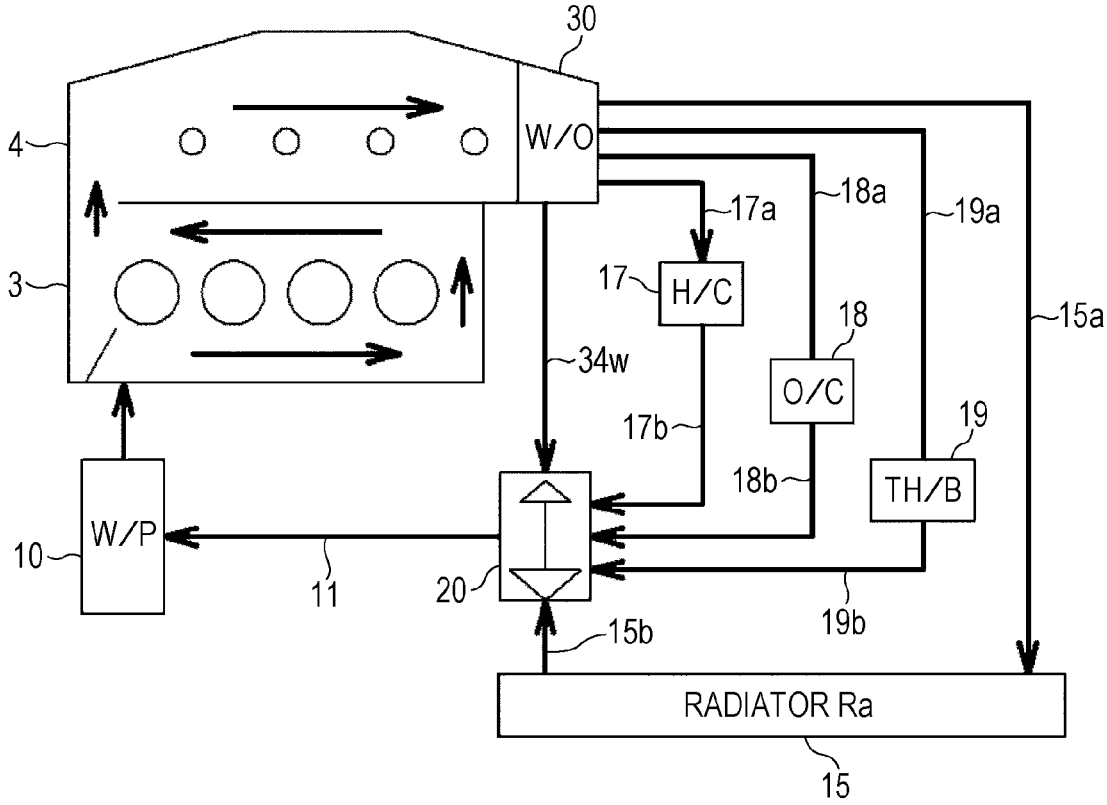
FIG. 2 schematically illustrates a cooling system in the internal combustion engine.

FIG. 2 schematically illustrates a cooling system in which cooling water is circulated by driving of the water pump 10. A main circulation path of the cooling system will be briefly described with reference to FIG. 2.

A thermostat 20 is provided integrally with the water outlet 30, and a bypass passage 34*w* is provided such that cooling water directly flows into the thermostat 20 therethrough.

From the water outlet 30, a radiator upstream passage 15*a* is laid to circulate cooling water to a radiator 15. From the radiator 15, a radiator downstream passage 15*b* is laid to reflux the cooling water to the thermostat 20.

From the water outlet 30, upstream passages 17*a*, 18*a*, and 19*a* are also laid to supply cooling water to a heater core 17 for air conditioning, an oil cooler 18, and a throttle body 19, respectively. From the heater core 17, the oil cooler 18, and the throttle body 19, downstream passages 17*b*, 18*b*, and 19*b* are laid to reflux the cooling water to the thermostat 20.

From the thermostat 20, a connecting pipe 11 is laid to reflux the cooling water to the water pump 10.

The main circulation path of the cooling system has the above-described configuration.

In a cold state, the thermostat 20 closes the radiator downstream passage 15*b* and opens the bypass passage 34*w*, so that cooling water flows through the cylinder block 3 and the cylinder head 4 without circulating in the radiator 15, thereby promoting a warm-up.

In a hot state, the thermostat 20 opens the radiator downstream passage 15*b* and closes the bypass passage 34*w*, so that cooling water, whose heat is removed by circulation in the radiator 15, flows through the cylinder block 3 and the cylinder head 4 and cools the cylinder block 3 and the cylinder head 4.

Cooling water flowing in the heater core 17, the oil cooler 18, and the throttle body 19 is refluxed to the water pump 10 via the thermostat 20. The cooling water is sucked by the water pump 10 and constantly circulates with little influence on wax 28 in the thermostat 20, and regardless of whether or not the thermostat 20 is driven.

Figure 3:
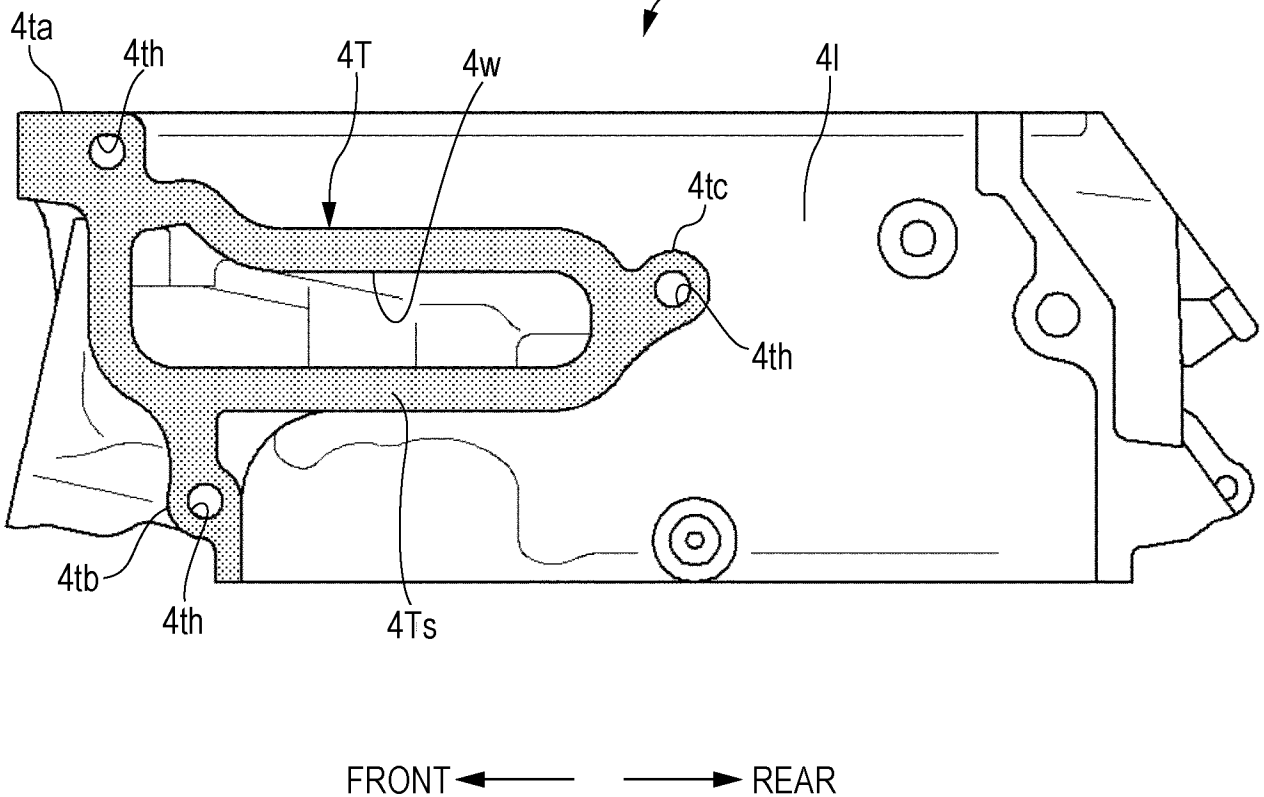
FIG. 3 is a left side view of a cylinder head.

The cylinder head 4 extends long in the cylinder arrangement direction (right-left direction). As illustrated in FIG. 3, a cooling-water outlet 4*w* extending in the front-rear direction is open in a front part of the left side face 41 of the cylinder head 4 to which the water outlet 30 is to be attached.

A front portion of the cooling-water outlet 4*w* extending long in the front-rear direction slightly bulges upward.

An attachment portion 4T provided around the cooling-water outlet 4*w* slightly projects leftward, and a vertical open end face thereof serves as an attachment face 4Ts.

A front end portion of the attachment portion 4T extends upward to form an attachment boss portion 4*ta*, and extends downward to form an attachment boss portion 4*tb*. A rear end portion of the attachment portion 4T further extends rearward to form an attachment boss portion 4*tc*.

Each of the three attachment boss portions 4*ta*, 4*tb*, and 4*tc* has an attachment hole 4*th*.

The water outlet 30 to be attached to the attachment portion 4T on the left side face 41 of the cylinder head 4 will be described in detail below with reference to FIGS. 4 to 9.

Figure 6:
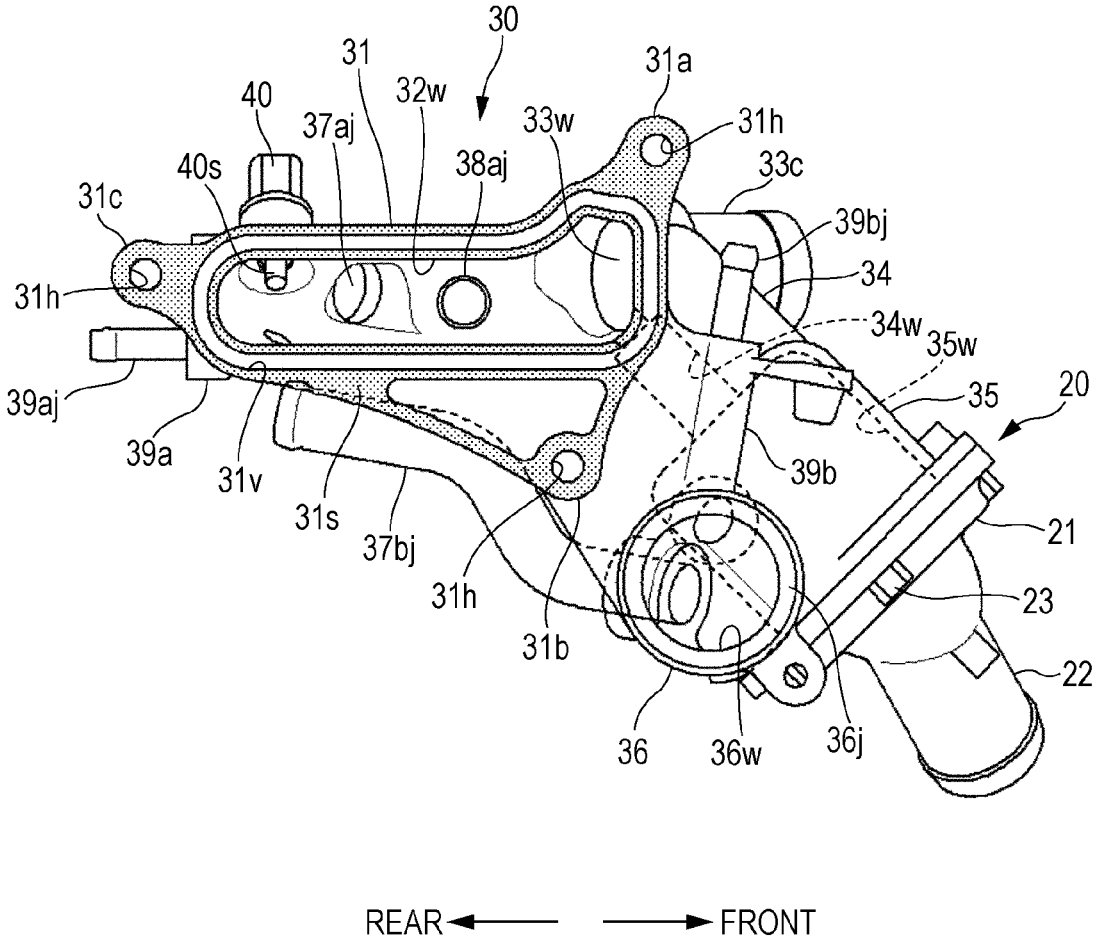
FIG. 6 is a back view (right side view) of the water outlet.

A fastening base portion 31 of the water outlet 30 corresponding to the attachment portion 4T of the cylinder head 4 includes an attachment face 31*s* to be in contact with the attachment face 4Ts of the attachment portion 4T (see FIG. 6). A cooling-water inflow housing 32 bulges leftward from the fastening base portion 31 (see FIG. 4).

The cooling-water inflow housing 32 has an aperture in the attachment face 31*s* of the fastening base portion 31. The aperture horizontally extends long in the front-rear direction, opposes the cooling-water outlet 4*w* of the cylinder head 4 extending long in the front-rear direction, and has the same shape as that of the cooling-water outlet 4*w*. A cooling-water inflow recess 32*w* is concave leftward to the aperture.

Around the aperture of the cooling-water inflow recess 32*w* at the fastening base portion 31, fastening portions 31*a*, 31*b*, and 31*c*, each having an attachment hole 31*h*, are provided in correspondence to the three attachment boss portions 4*ta*, 4*tb*, and 4*tc* of the attachment portion 4T in the cylinder head 4 (see FIG. 6).

In the water outlet 30, a radiator outflow cylindrical portion 33 projects to a leftward front side from a slightly upward bulging front portion of a bottom face (left inner side face) of the cooling-water inflow recess 32*w* horizontally extending in the front-rear direction. A radiator outflow passage connecting pipe 33*j* is coaxially fitted in the radiator outflow cylindrical portion 33 to form a radiator outflow passage 33*w* through which cooling water flows out from the cooling-water inflow recess 32*w* to the radiator 15 (see FIGS. 4 and 7).

Figure 7:
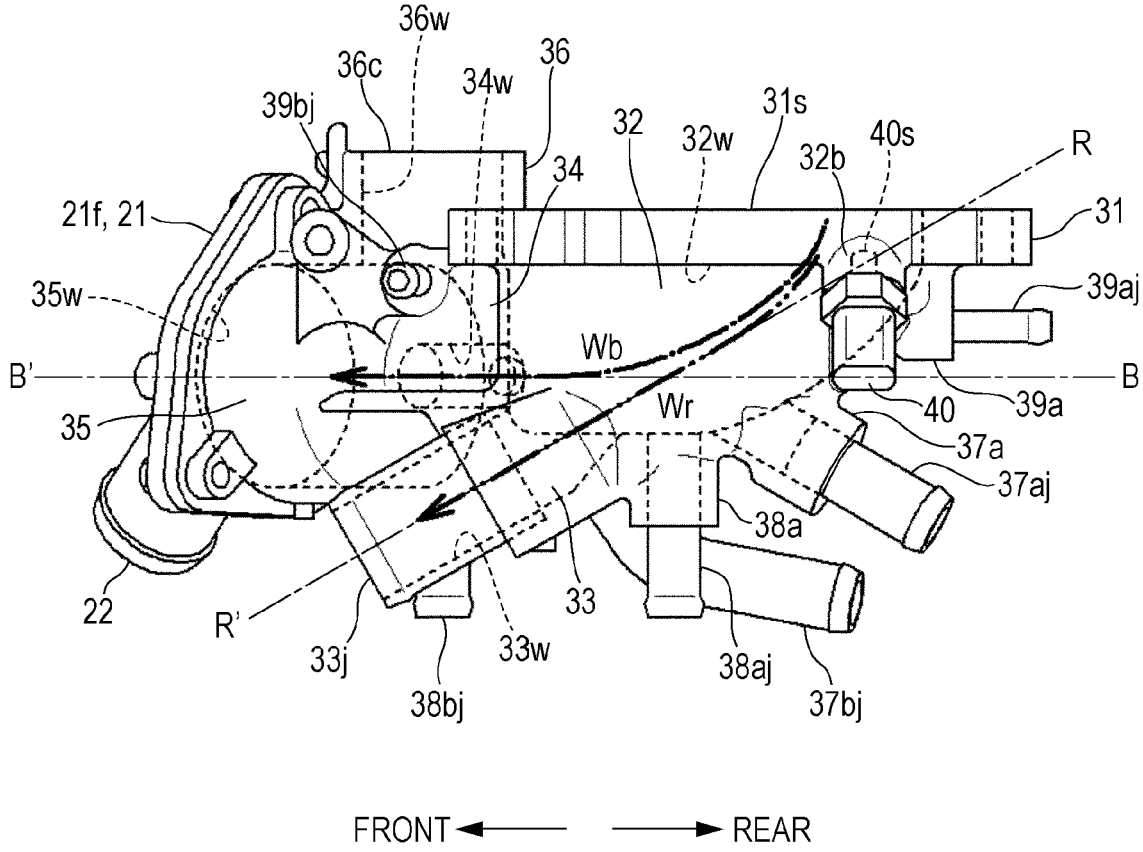
FIG. 7 is a top view (a plan view) of the water outlet.
Figure 8:
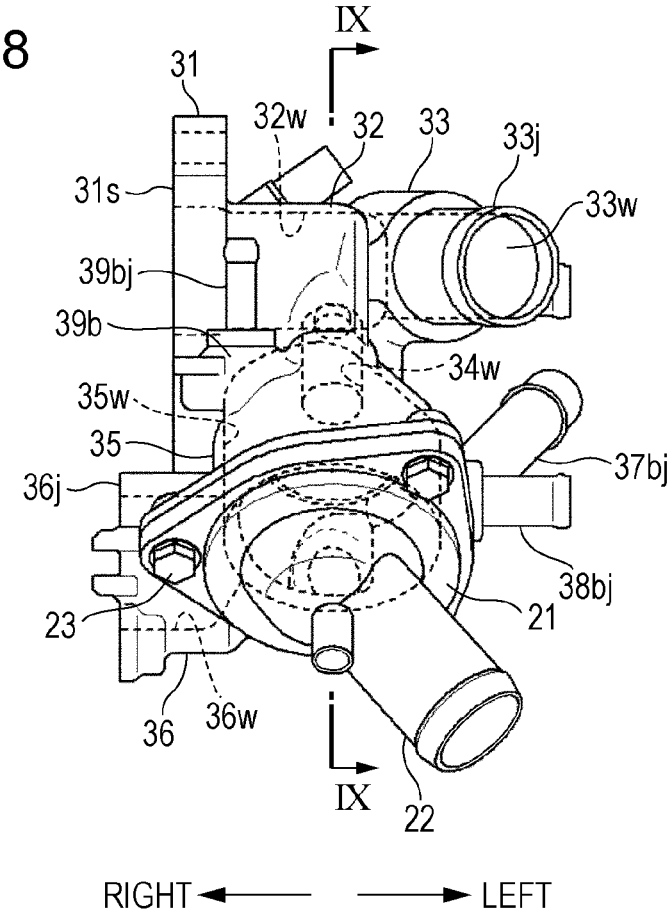
FIG. 8 is a front view of the water outlet.

The radiator outflow passage 33*w* is provided at the same height as that of the cooling-water inflow recess 32*w*. Referring to FIG. 7 serving as a top view of the water outlet 30, an angle formed by a center axis R-R' of the radiator outflow cylindrical portion 33 and the attachment face 31*s* of the fastening base portion 31 is an acute angle of about 30 degrees in top view.

In the water outlet 30, a thermo housing 35 of the thermostat 20 extends to a lower front side from a front end portion of the cooling-water inflow recess 32*w* horizontally extending long in the front-rear direction in a manner such that a thermo connecting portion 34 is provided between the thermo housing 35 and the cooling-water inflow recess 32*w*.

The thermo housing 35 is a substantially cylindrical container that is open to the lower front side. A bypass passage 34*w* in the thermo connecting portion 34 communicates between a bottom portion of a thermo-housing inner space 35*w* in the thermo housing 35 and the front end portion of the cooling-water inflow recess 32*w* in the cooling-water inflow housing 32.

A cylindrical wall on a lower side of the cylindrical thermo housing 35 extending to the lower front side bulges obliquely downward to form a cooling-water outflow passage portion 36 extending rightward. The cooling-water outflow passage portion 36 forms a cooling-water outflow passage 36*w* having an outflow opening end 36*j* on a right side (see FIGS. 6, 8, and 9).

Figure 9:
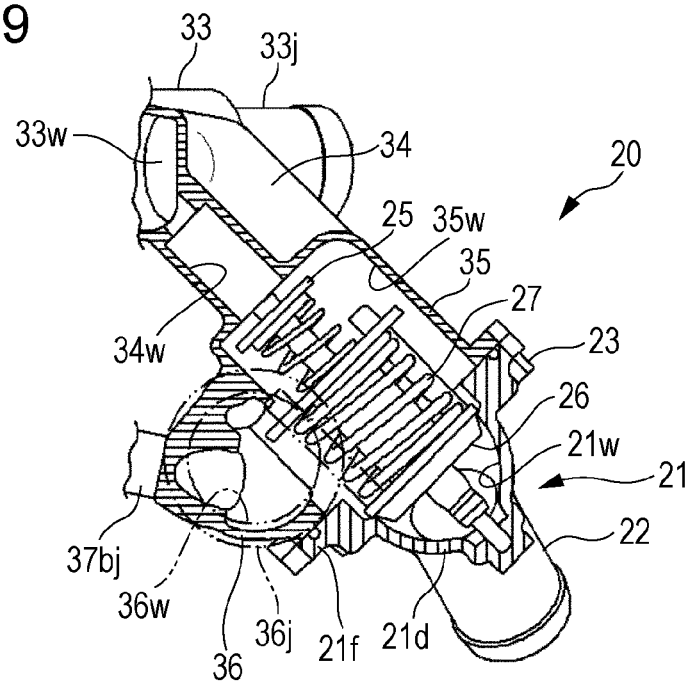
FIG. 9 is a cross-sectional view, taken along line IX-IX of FIG. 8.

The cooling-water outflow passage 36*w* overlaps with a lower portion of the thermo-housing inner space 35*w* to define a common space (see FIGS. 6 and 9).

The opening of the thermo housing 35 facing toward the lower front side is closed by being covered with a thermo cover 21.

The thermo cover 21 includes a center dome portion 21*d* and a flange portion 21*f* provided around the dome portion 21*d*. Three fastening portions of the flange portion 21*f* are fastened to the thermo housing 35 by attachment bolts 23 while the flange portion 21*f* is in contact with an open end face of the thermo housing 35.

A radiator inflow passage connecting pipe 22 extends from the dome portion 21*d* of the thermo cover 21.

Referring to FIG. 9, the thermostat 20 includes a bypass passage valve 25 that movably separates the thermo-housing inner space 35*w* of the thermo housing 35 and the bypass passage 34*w* extending from the bottom portion of the thermo housing 35, and a radiator passage valve 26 that movably separates the thermo-housing inner space 35*w* and a thermo-cover inner space 21*w* in the thermo cover 21. The bypass passage valve 25 and the radiator passage valve 26 are connected to move together. When one of the bypass passage valve 25 and the radiator passage valve 26 opens, the other valve closes. When one of the bypass passage valve 25 and the radiator passage valve 26 opens, the other valve closes.

The bypass passage valve 25 and the radiator passage valve 26 are biased by a spring 27 in a direction such that the bypass passage valve 25 opens and the radiator passage valve 26 closes (in an obliquely downward direction). When the wax 28 provided in the thermo-housing inner space 35*w* is thermally expanded by the rise of temperature of cooling water, it moves the bypass passage valve 25 and the radiator passage valve 26 in an obliquely upward direction against the spring 27 so as to close the bypass passage valve 25 and open the radiator passage valve 26.

In the water outlet 30, the bypass passage 34*w* extends to the lower front side of the cooling-water inflow recess 32*w* that horizontally extends long in the front-rear direction. The thermo housing 35 extends downstream from the bypass passage 34*w*. The bypass passage valve 25 and the radiator passage valve 26 in the thermo-housing inner space 35*w* are opened and closed by being moved in a direction in which the bypass passage 34*w* points.

Figure 4:
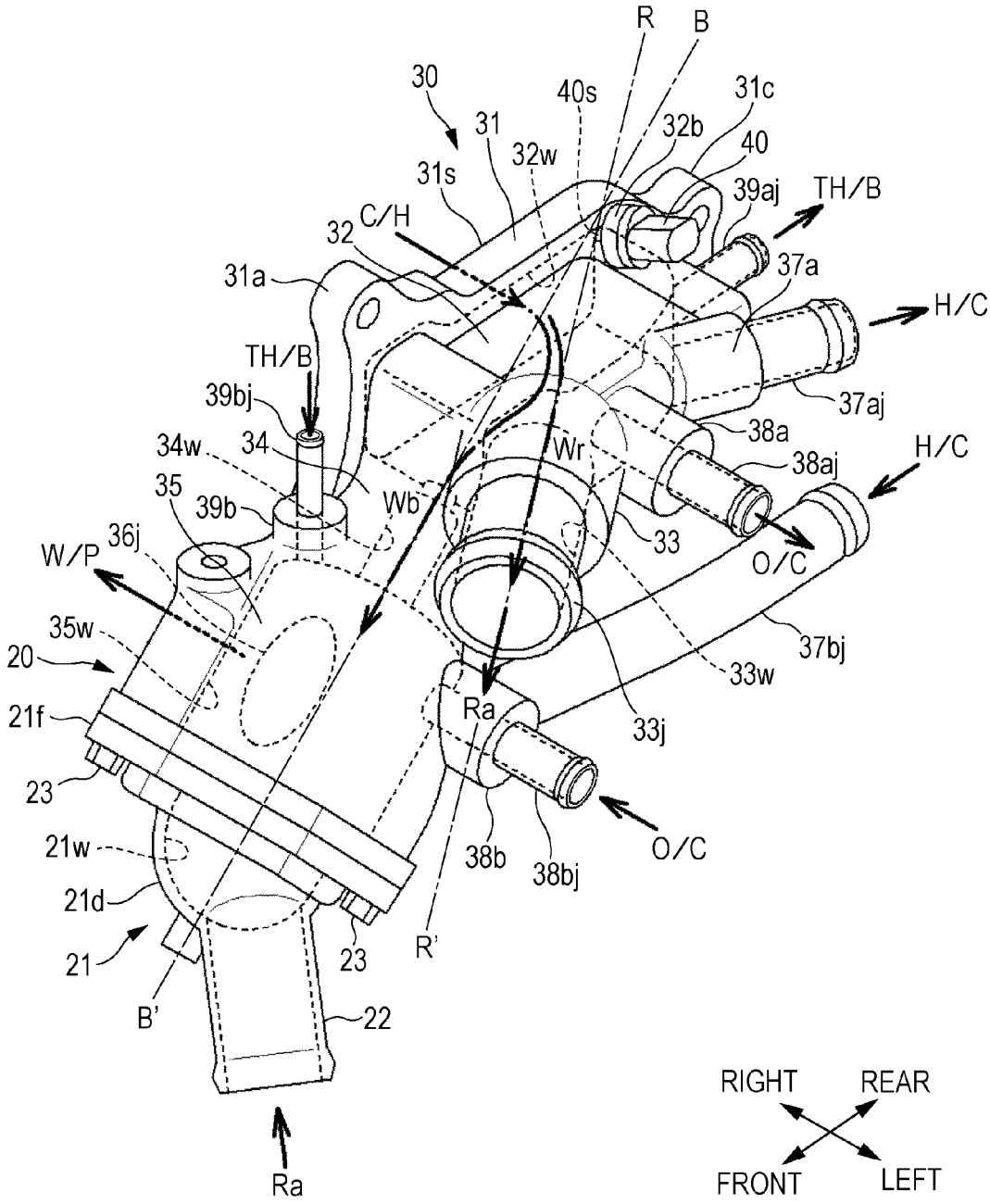
FIG. 4 is a perspective view of a water outlet.

FIG. 4 is a perspective view of the water outlet 30. Referring to FIG. 4, a center axis B-B' of the bypass passage 34*w* extending to the lower front side of the cooling-water inflow recess 32*w*, which horizontally extends long in the front-rear direction, forms an acute angle with the center axis R-R' of the radiator outflow cylindrical portion 33.

In the water outlet 30, the center axis B-B' of the bypass passage 34*w* and the center axis R-R' of the radiator outflow cylindrical portion 33 form an acute angle of about 45 degrees in left side view (FIG. 5), and form an acute angle of about 30 degrees in top view (FIG. 7).

Further, as illustrated in FIG. 4, in the water outlet 30, a heater-core outflow cylindrical portion 37*a* projects obliquely rearward from a rear portion of a left side face of the cooling-water inflow housing 32. A heater-core outflow passage connecting pipe 37*aj* is coaxially fitted in the heater-core outflow cylindrical portion 37*a* to form a passage through which cooling water flows out from the cooling-water inflow recess 32*w* to the heater core 17.

From a portion of the left side face of the cooling-water inflow housing 32 between the radiator outflow cylindrical portion 33 and the heater-core outflow cylindrical portion 37*a*, an oil-cooler outflow cylindrical portion 38*a* projects leftward. An oil-cooler outflow passage connecting pipe 38*aj* is coaxially fitted in the oil-cooler outflow cylindrical portion 38*a* to form a passage through which cooling water flows out from the cooling-water inflow recess 32*w* to the oil cooler 18.

From a rear face of the cooling-water inflow housing 32, a throttle-body outflow cylindrical portion 39*a* projects rearward. A throttle-body outflow passage connecting pipe 39*aj* is coaxially fitted in the throttle-body outflow cylindrical portion 39*a* to form a passage through which cooling water flows out from the cooling-water inflow recess 32*w* to the throttle body 19 (see FIG. 5).

Figure 5:
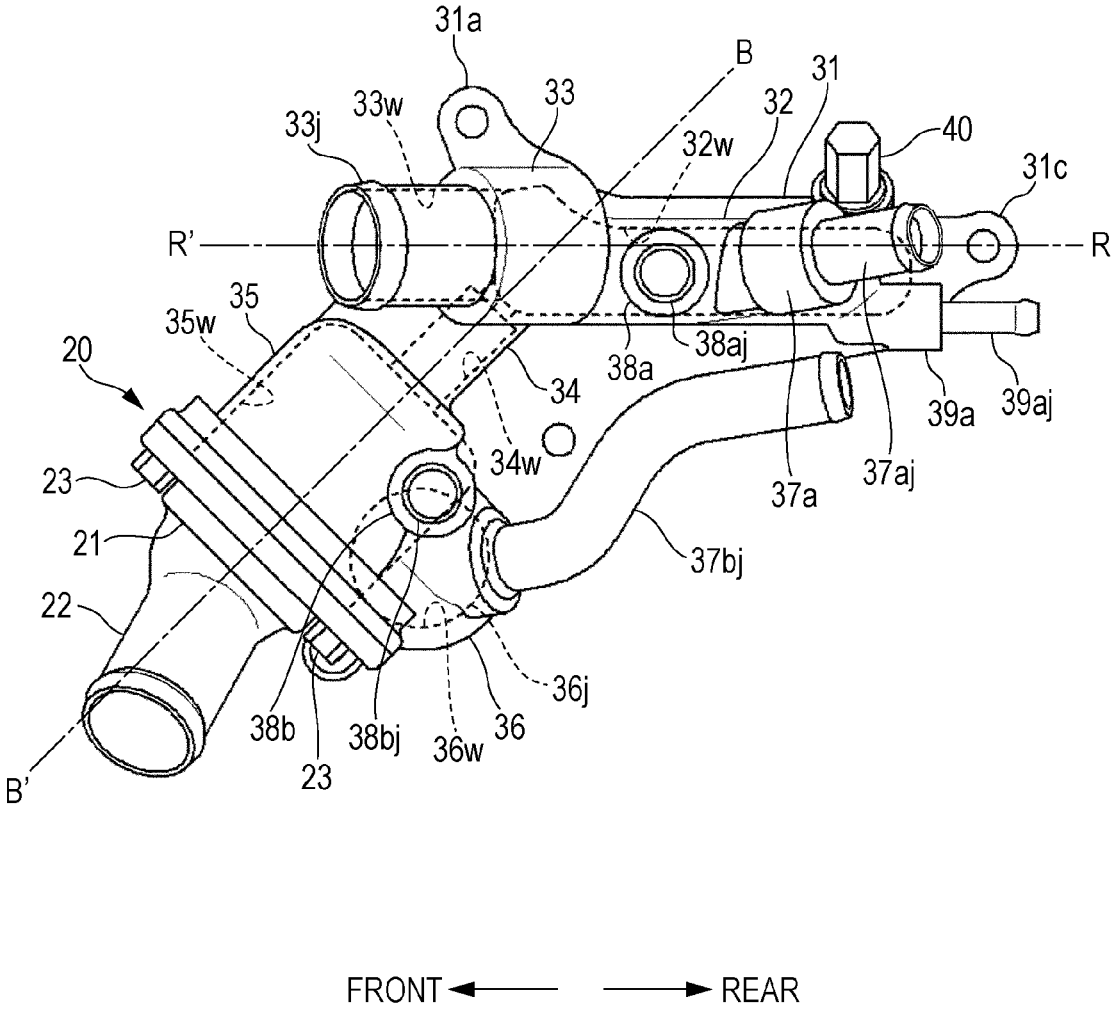
FIG. 5 is a left side view of the water outlet.

A heater-core inflow passage connecting pipe 37*bj* extends rearward from the cooling-water outflow passage portion 36 that bulges on the lower side of the thermo housing 35 of the water outlet 30 (FIG. 5).

The heater-core inflow passage connecting pipe 37*bj* is bent in an obliquely leftward and upward direction from the cooling-water outflow passage portion 36, and extends long rearward to form a passage through which cooling water flows from the heater core 17 into the cooling-water outflow passage portion 36.

An oil-cooler inflow cylindrical portion 38*b* projects leftward from an upper portion of the cooling-water outflow passage portion 36 that bulges on the lower side of the thermo housing 35 (see FIG. 5). In the oil-cooler inflow cylindrical portion 38*b*, an oil-cooler inflow passage connecting pipe 38*bj* is coaxially fitted to form a passage through which cooling water flows from the oil cooler 18 into the cooling-water outflow passage portion 36.

In addition, a throttle-body inflow cylindrical portion 39*b* projects upward from the upper portion of the cooling-water outflow passage portion 36. In the throttle-body inflow cylindrical portion 39*b*, a throttle-body inflow passage connecting pipe 39*bj* is coaxially fitted to form a passage through which cooling water flows from the throttle body 19 into the cooling-water outflow passage portion 36 (see FIG. 6).

The cooling-water inflow housing 32 of the water outlet 30 is provided with a water temperature sensor 40.

As illustrated in FIG. 4, the water temperature sensor 40 is fitted from the outside in an attachment boss portion 32*b* provided in an upper rear portion of the cooling-water inflow housing 32, and a temperature sensing portion 40*s* at an end of the water temperature sensor 40 is inserted in an upper rear portion of the cooling-water inflow recess 32*w* (see FIG. 6).

The temperature sensing portion 40*s* of the water temperature sensor 40 is substantially located on the center axis R-R' of the radiator outflow cylindrical portion 33 (see FIGS. 4 and 7).

The water outlet 30 having the above-described structure is attached to the attachment portion 4T of the cylinder head 4.

Figure 10:
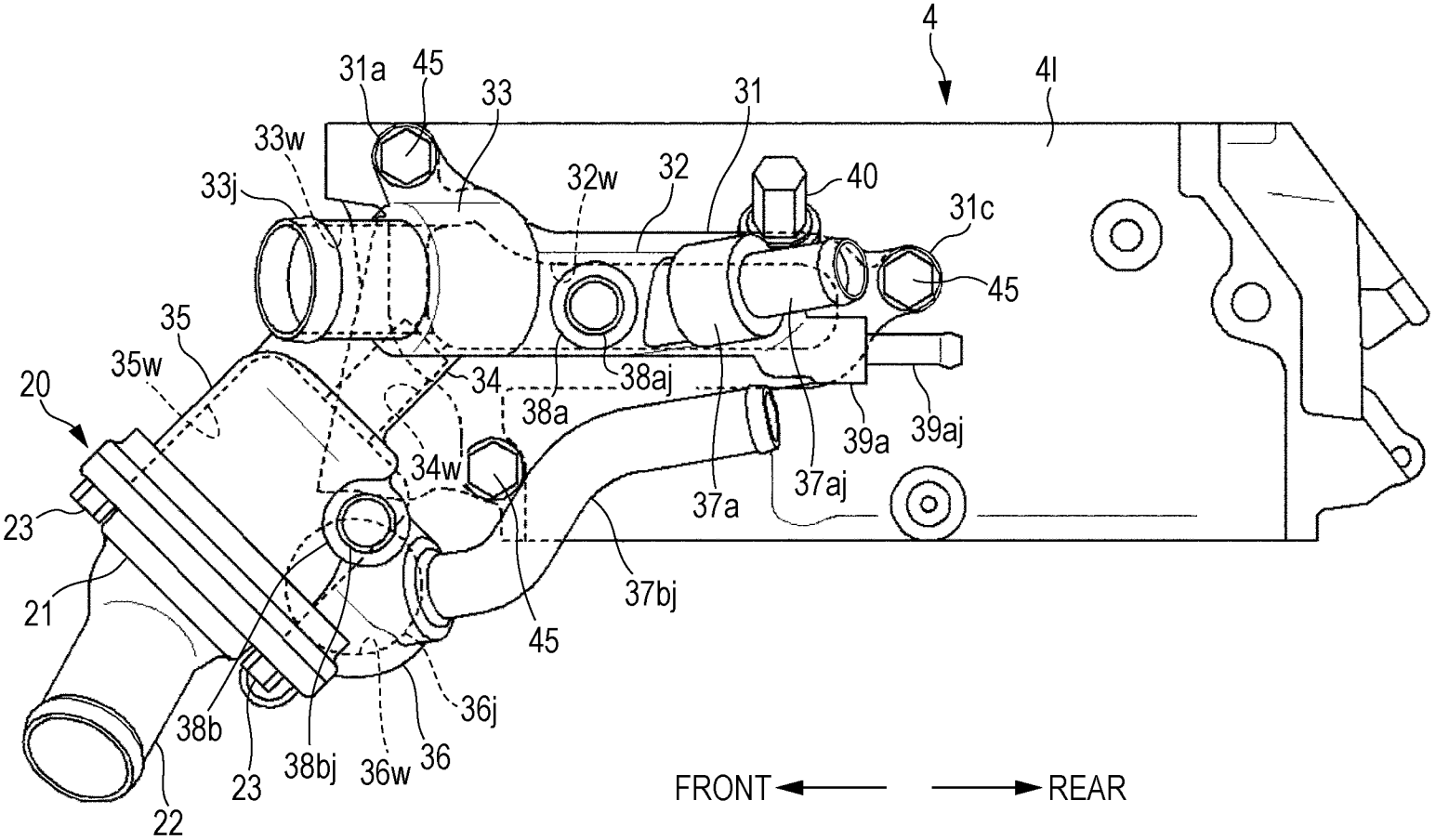
FIG. 10 is a left side view of the cylinder head to which the water outlet is attached.

The water pump housing 30 is attached to the left side face 41 of the cylinder head 4 by bringing the attachment face 31*s* of the fastening base portion 31 of the water outlet 30 in which the cooling-water inflow recess 32*w* is open into contact with the attachment face 4Ts of the attachment portion 4T of the cylinder head 4 in which the cooling-water outlet 4*w* is open, passing three attachment bolts 45 through the attachment holes 31*h* of the three fastening portions 31*a*, 31*b*, and 31*c* of the fastening base portion 31, and screwing and fastening the attachment bolts 45 to the attachment holes 4*th* of the three attachment boss portions 4*ta*, 4*tb*, and 4*tc* of the cylinder head 4 (see FIGS. 1 and 10).

The cooling-water outlet 4*w* of the cylinder head 4 communicates with the cooling-water inflow recess 32*w* of the water outlet 30, so that cooling water circulating in the cylinder head 4 flows from the cooling-water outlet 4*w* into the cooling-water inflow recess 32*w* of the water outlet 30.

The connecting pipe 11 linked to the water pump 10 is connected to the outflow opening end 36*j* provided in the cooling-water outflow passage portion 36 on the lower side of the thermo housing 35 of the water outlet 30, so that cooling water flowing out from the cooling-water outflow passage 36*w* communicating with the thermo-housing inner space 35*w* is refluxed to the water pump 10 via the connecting pipe 11.

The radiator upstream passage 15*a* is connected to the radiator outflow passage connecting pipe 33*j* projecting from the water outlet 30, and the radiator downstream passage 15*b* is connected to the radiator inflow passage connecting pipe 22. This forms a passage in which cooling water circulates in the radiator 15.

The upstream passage 17*a* of the heater core 17 is connected to the heater-core outflow passage connecting pipe 37*aj*, and the downstream passage 17*b* of the heater core 17 is connected to the heater-core inflow passage connecting pipe 37*bj*. This forms a passage in which cooling water passes through the heater core 17.

The upstream passage 18*a* of the oil cooler 18 is connected to the oil-cooler outflow passage connecting pipe 38*aj*, and the downstream passage 18*b* of the oil cooler 18 is connected to the oil-cooler inflow passage connecting pipe 38*bj*. This forms a passage in which cooling water passes through the oil cooler 18.

The upstream passage 19*a* of the throttle body 19 is connected to the throttle-body outflow passage connecting pipe 39*aj*, and the downstream passage 19*b* of the throttle body 19 is connected to the throttle-body inflow passage connecting pipe 39*bj*. This forms a passage in which cooling water passes through the throttle body 19.

As described above, the circulation path for cooling water in the cooling system is formed.

Cooling water passing through the heater core 17, the oil cooler 18, and the throttle body 19 returns to the cooling-water outflow passage 36*w* of the cooling-water outflow passage portion 36 that overlaps with the thermo-housing inner space 35*w* of the water outlet 30. Hence, the cooling water is sucked by the water pump 10 and constantly circulates, regardless of whether or not the thermostat 20 is driven, and with little influence on the wax 28 in the thermo-housing inner space 35*w*.

In a cold state, the thermostat 20 opens the bypass passage valve 25 and closes the radiator passage valve 26. Therefore, cooling water, which circulates in the cylinder block 3 and the cylinder head 4 and flows into the cooling-water inflow recess 32*w* of the water outlet 30, flows frontward in the cooling-water inflow recess 32*w* that horizontally extends long in the front-rear direction, and enters the thermo-housing inner space 35*w* through the open bypass passage valve 25 in the bypass passage 34*w* extending to the lower front side from the front end of the cooling-water inflow recess 32*w* (see arrows of one-dot chain lines of FIGS. 4 and 7). Then, the cooling water is refluxed to the water pump 10 via the cooling-water outflow passage 36*w*, the outflow opening end 36*j*, and the connecting pipe 11.

In this way, in the cold state, the cooling water circulates in the cylinder block 3 and the cylinder head 4, passes through the bypass passage 34*w* without passing through the radiator 15, and is refluxed to the water pump 10. This promotes a warm-up.

In contrast, in a hot state, the thermostat 20 closes the bypass passage valve 25 and opens the radiator passage valve 26 by thermal expansion of the wax 28. Hence, cooling water, which circulates in the cylinder block 3 and the cylinder head 4 and flows into the cooling-water inflow recess 32*w* of the water outlet 30, flows in a frontward and leftward direction in the cooling-water inflow recess 32*w* toward the radiator outflow passage 33*w* of the radiator outflow cylindrical portion 33 (see arrows of two-dotted chain lines of FIGS. 4 and 7), circulates in the radiator 15 via the radiator upstream passage 15*a*, and returns to the thermo-cover inner space 21*w* of the thermostat 20. Then, the cooling water enters the thermo-housing inner space 35*w* via the open radiator passage valve 26, and is refluxed to the water pump 10 via the cooling-water outflow passage 36*w*, the outflow opening end 36*j*, and the connecting pipe 11.

In this way, in the hot state, the cooling water circulates in the cylinder block 3 and the cylinder head 4 via the radiator 15, and this cools the engine body 2.

The above-described flow of cooling water in the cooling-water inflow recess 32*w* of the water outlet 30 will be considered. Referring to FIGS. 4 and 7, a main flow Wb of cooling water passing through the bypass passage 34*w* in a cold state travels along the center axis B-B' of the bypass passage 34*w*, as shown by the arrow of a one-dot chain line. A main flow Wr of cooling water passing through the radiator outflow passage 33*w* in a hot state travels along the center axis R-R' of the radiator outflow passage 33*w* (radiator outflow cylindrical portion 33), as shown by the arrow of a two-dotted chain line.

Since the center axis B-B' of the bypass passage 34*w* and the center axis R-R' of the radiator outflow cylindrical portion 33 form an acute angle, the main flow Wb of cooling water in the cold state and the main flow Wr of cooling water in the hot state form water flows that separate from each other at an acute angle.

Therefore, when the thermostat 20 operates to open and close the bypass passage valve 25 and the radiator passage valve 26, cooling water, which flows from the cylinder head 4 into the cooling-water inflow recess 32*w* of the water outlet 30, changes its passage from one of the radiator outflow passage 33*w* and the bypass passage 34*w* to the other passage. Since the directions of the water flow in the radiator outflow passage 33*w* (main flow Wr of cooling water in the hot state) and the water flow in the bypass passage 34*w* (main flow Wb of cooling water in the cold state) are oblique to each other at an acute angle, the passage is smoothly changed while suppressing disturbance of the water flow, and pressure loss in the cooling water resulting from the passage change is reduced.

In the thermo housing 35, the bypass passage valve 25 and the radiator passage valve 26 are opened and closed by being moved in the direction in which the bypass passage 34*w* points. Hence, cooling water in the bypass passage 34*w* linearly flows until it enters the thermo housing 35. This further reduces pressure loss in cooling water flowing in the bypass passage 34*w*, and enhances temperature sensitivity of the wax 28 in the thermo housing 35 because the cooling water evenly flows with little disturbance.

The temperature sensing portion 40*s* of the water temperature sensor 40 provided on the rear side of the cooling-water inflow recess 32*w* of the water outlet 30 is substantially located on the center axis R-R' of the radiator outflow cylindrical portion 33.

That is, the temperature sensing portion 40*s* of the water temperature sensor 40 is located on an extension of the linear radiator outflow passage 33*w* toward the cooling-water inflow recess 32*w*. Hence, the temperature sensing portion 40*s* of the water temperature sensor 40 is located in the main flow Wr of cooling water smoothly flowing from the cooling-water inflow recess 32*w* to the radiator outflow passage 33*w*. This allows the temperature-sensitive portion 40*s* to accurately detect a required cooling water temperature.

The bypass passage 34*w* forms a water flow in a direction at an acute angle to the water flow traveling from the cooling-water inflow recess 32*w* to the radiator outflow passage 33*w*. Hence, when cooling water flows in the bypass passage 34*w*, the temperature sensing portion 40*s* of the water temperature sensor 40 is located near a portion where the main flow Wb of cooling water in the bypass passage 34*w* separates from the main flow Wr in the upstream radiator outflow passage 33*w*, and can properly detect the temperature of the cooling water. Thus, even when the passage is changed by opening or closing the bypass passage 34*w*, the temperature sensor 40 can constantly and stably detect the temperature of cooling water without any influence.

A water outlet structure of an internal combustion engine according to an aspect of the embodiment includes: a water outlet (30) attached to a cooling-water outlet (4*w*) provided at an end of a cylinder head (4) in a cylinder arrangement direction; and a thermostat (20) provided integrally with the water outlet (30). The water outlet (30) includes a cooling-water inflow portion (32*w*) opposing the cooling-water outlet (4*w*) of the cylinder head (4), a radiator outflow passage (33*w*) linearly extending from the cooling-water inflow portion (32*w*) to allow cooling water to flow out therethrough to a radiator (15), a bypass passage (34*w*) linearly and obliquely extending from the cooling-water inflow portion (32*w*) to form a water flow at an acute angle to a water flow in the radiator outflow passage (33*w*), and a thermo housing (35) provided downstream of the bypass passage (34*w*).

According to the water outlet structure of the internal combustion engine of the embodiment, when the bypass passage (34*w*) is opened by driving of the thermostat (20), cooling water, which flows from the cooling-water outlet (4*w*) of the cylinder head (4) into the cooling-water inflow portion (32*w*), flows through the bypass passage (34*w*) from the cooling-water inflow portion (32*w*). In contrast, when the bypass passage (34*w*) is closed, the cooling water flows through the radiator outflow passage (33*w*) from the cooling-water inflow portion (32*w*). Thus, the passage is changed by opening and closing the bypass passage (34*w*). Since directions of a main flow (Wr) of cooling water in the radiator outflow passage (33*w*) and a main flow (Wb) of cooling water in the bypass passage (34*w*) form an acute angle, the passage is smoothly changed while restricting disturbance of the water flow, and pressure loss in the cooling water flow resulting from the change of the passage is reduced.

Preferably, a passage valve (25, 26) provided in the thermo housing (35) is opened and closed by being moved in a direction in which the bypass passage (34*w*) points.

In this embodiment, cooling water in the bypass passage (34*w*) linearly flows until it enters the thermo housing (35). This further reduces pressure loss in the cooling water flowing in the bypass passage (34*w*), and enhances the temperature sensitivity of wax (28) in the thermo housing (35) because the cooling water evenly flows with little disturbance.

Preferably, a water temperature sensor (40) is provided at the cooling-water inflow portion (32*w*) of the water outlet (30), and a temperature sensing portion (40*s*) of the water temperature sensor (40) is located on an upstream extension of the linear radiator outflow passage (33*w*).

In this embodiment, the temperature sensing portion (40*s*) of the water temperature sensor (40) is located in the main flow (Wr) of cooling water smoothly flowing from the cooling-water inflow portion (32*w*) to the radiator outflow passage (33*w*), and therefore can accurately detect a required cooling water temperature.

The bypass passage (34*w*) of the embodiment forms the water flow at an acute angle to the water flow (Wr) from the cooling-water inflow portion (32*w*) to the radiator outflow passage (33*w*). Hence, when cooling water flows through the bypass passage (34*w*), the temperature sensing portion (40*s*) of the water temperature sensor (40) is located near a portion where the main flow (Wb) of cooling water at that time separates from the main flow (Wr) in the upstream radiator outflow passage (33*w*), and properly detects the cooling water temperature. Therefore, even when the passage is changed by opening or closing the bypass passage (34*w*), the water temperature sensor of the embodiment (40) can accurately and stably detect the cooling water temperature without any influence.

Obviously, numerous modifications and variations of the present invention are possible in light of the above teachings. It is therefore to be understood that within the scope of the appended claims, the invention may be practiced otherwise than as specifically described herein.

What is claimed is:

1. A water outlet structure of an internal combustion engine, comprising:

a water outlet provided to be attached to a cooling-water outlet provided at an end of a cylinder head of the internal combustion engine in a cylinder arrangement direction of the internal combustion engine, the water outlet comprising:

a cooling-water inflow portion provided to face the cooling-water outlet of the cylinder head;

an attachment face configured to be in contact with the cooling-water outlet;

a radiator outflow passage through which cooling water is to flow out to a radiator, the radiator outflow passage linearly extending from the cooling-water inflow portion in a first direction forming an acute angle to the attachment face when viewed from above the water outlet; and a bypass passage linearly extending from the cooling-water inflow portion in a second direction to provide a water flow at an acute angle to a water flow in the radiator outflow passage when viewed from above the water outlet, the second direction being defined along the attachment face and oblique relative to the first direction when viewed from a third direction perpendicular to the attachment face; and a thermostat provided integrally with the water outlet and including a thermo housing provided downstream of the bypass passage, wherein the bypass passage is provided sandwiched between the cylinder head and the radiator outflow passage when viewed from above the water outlet, wherein the first direction is substantially parallel to a horizontal plane, and wherein the second direction forms an acute angle to the first direction when viewed from the third direction.

2. The water outlet structure of the internal combustion engine according to claim 1, wherein the thermostat includes a passage valve provided in the thermo housing to be opened and closed by being moved in a direction in which the bypass passage extends.

3. The water outlet structure of the internal combustion engine according to claim 1, further comprising:

a water temperature sensor provided at the cooling-water inflow portion of the water outlet, wherein the water temperature sensor includes a temperature sensing portion located substantially on an upstream extension of the radiator outflow passage.

4. The water outlet structure of the internal combustion engine according to claim 3, wherein the radiator outflow passage includes a center axis along which the radiator outflow passage extends, and wherein the temperature sensing portion is located substantially on the center axis of the radiator outflow passage in a plan view of the water outlet structure.

5. The water outlet structure of the internal combustion engine according to claim 1, wherein the radiator outflow passage extends substantially in a horizontal direction, and wherein the bypass passage is downwardly inclined from the cooling-water inflow portion.

6. The water outlet structure of the internal combustion engine according to claim 1, wherein the thermo housing is provided integrally with the water outlet as a one-piece unitary member.

7. The water outlet structure of the internal combustion engine according to claim 1, wherein the second direction is substantially parallel to the attachment face, and wherein the first direction forms an angle of approximately 30 degrees to the attachment face when viewed from above the water outlet.

8. The water outlet structure of the internal combustion engine according to claim 1, wherein the second direction forms an angle of approximately 45 degrees to the first direction when viewed from the third direction.

9. An internal combustion engine comprising:

a cylinder head including a cooling-water outlet provided at an end of the cylinder head in a cylinder arrangement direction of the internal combustion engine;

a water outlet attached to the cooling-water outlet and comprising:

an attachment face configured to be in contact with the cooling-water outlet;

a cooling-water inflow portion provided to face the cooling-water outlet of the cylinder head;

a radiator outflow passage through which cooling water is to flow out to a radiator, the radiator outflow passage linearly extending from the cooling-water inflow portion in a first direction forming an acute angle to the attachment face when viewed from above the water outlet; and a bypass passage linearly extending from the cooling-water inflow portion in a second direction to provide a water flow at an acute angle to a water flow in the radiator outflow passage when viewed from above the water outlet, the second direction being defined along the attachment face and oblique relative to the first direction when viewed from a third direction perpendicular to the attachment face; and a thermostat provided integrally with the water outlet and including a thermo housing provided downstream of the bypass passage, wherein the bypass passage is provided sandwiched between the cylinder head and the radiator outflow passage when viewed from above the water outlet, wherein the first direction is substantially parallel to a horizontal plane, and wherein the second direction forms an acute angle to the first direction when viewed from the third direction.

* * * * *